US006494681B2

(12) United States Patent
Barry et al.

(10) Patent No.: US 6,494,681 B2
(45) Date of Patent: Dec. 17, 2002

(54) COMBINED AXIAL FLOW AND CENTRIFUGAL FAN IN AN ELECTRICAL MOTOR

(75) Inventors: Andrew C. Barry, Fort Wayne, IN (US); Timothy O. Williams, Fort Wayne, IN (US); Ricky R. Haynie, Fort Wayne, IN (US); Jon Schlemmer, Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/751,667

(22) Filed: Dec. 29, 2000

(65) Prior Publication Data

US 2002/0085915 A1 Jul. 4, 2002

(51) Int. Cl.[7] ..... F04D 13/12

(52) U.S. Cl. ..... 416/175; 416/203; 416/234; 415/143; 417/423.8

(58) Field of Search ..... 415/77, 83, 91, 415/915, 143; 416/234, 203, 175, DIG. 3; 417/423.8; 29/888.24, 888.25, 889, 889.3, 889.4

(56) References Cited

U.S. PATENT DOCUMENTS 1,300,552 A * 4/1919 Barr ..... 416/91
2,827,261 A * 3/1958 Parker et al. ..... 415/77
3,143,283 A * 8/1964 Downs ..... 415/77
3,635,589 A * 1/1972 Kristiansen ..... 416/193
4,063,060 A 12/1977 Litch, III
4,136,529 A 1/1979 McCarty
4,161,812 A 7/1979 Litch, III
4,200,257 A 4/1980 Litch, III
RE31,820 E 1/1985 Litch, III
4,950,932 A 8/1990 Harms et al.
5,010,729 A 4/1991 Adamson et al.
5,967,764 A * 10/1999 Booth et al. ..... 417/423.8
6,045,327 A 4/2000 Amr
6,137,197 A 10/2000 Taniguchi et al.
6,185,943 B1 2/2001 Kopko
6,241,474 B1 6/2001 Alizadeh et al.
6,254,476 B1 7/2001 Choi
6,273,679 B1 8/2001 Na
6,282,746 B1 9/2001 Schleeter
6,287,078 B1 9/2001 Min et al.

* cited by examiner

*Primary Examiner*—Edward K. Look
*Assistant Examiner*—Ninh Nguyen
(74) *Attorney, Agent, or Firm*—Karl A. Vick, Esq.; Armstrong Teasdale LLP

(57) ABSTRACT

In an exemplary embodiment, a motor assembly includes a shaft and a compound fan assembly that provides axial and centrifugal air flow. The fan assembly includes a body including an outer surface, a cavity defined by the body outer surface, a plurality of first blades extending radially outwardly from the body outer surface, and a plurality of second blades disposed within the cavity. The shaft is concentric with the body and the second blades are rotatably coupled to the shaft.

22 Claims, 5 Drawing Sheets

FIG. 1 : PRIOR ART

COMBINED AXIAL FLOW AND CENTRIFUGAL FAN IN AN ELECTRICAL MOTOR

BACKGROUND OF THE INVENTION

This invention relates generally to fans, and more particularly, to electric motor assemblies that include fans.

Fans are incorporated into different types of machines and systems including heating, ventilating, and air-conditioning (HVAC) systems. HVAC systems typically utilize supply and exhaust or return air fans. In addition, high-efficiency centrifugal fans have sometimes been used to supply air through duct systems and to cool motors. Such fans are chosen based on aerodynamic, economic, and functional suitability considerations.

Many HVAC systems utilize relatively large axial flow fans in condenser units to draw air across a plurality of condenser coils. These systems also typically utilize auxiliary centrifugal fans to draw cooling air through the axial fan motor. Such dual fan systems use a long shaft to mount the two separate fans. In addition, such systems, wherein an end user or wholesaler mounts the fans to a shaft, are subject to vibration and noise problems and require additional assembly.

BRIEF SUMMARY OF THE INVENTION

In an exemplary embodiment, a motor assembly includes a compound fan assembly that generates axial air flow and centrifugal air flow. The fan assembly includes a body including an outer surface, a cavity defined by the body outer surface, a plurality of first blades disposed within the cavity, and a plurality of second blades that extend radially outwardly from the body outer surface. The fan assembly further includes a shaft concentric with the body, the second blades and a least a portion of the first blades configured to be rotatably coupled to the shaft. The first blades and the second blades are configured such that the first blades discharge air in a first direction and the second blades discharge air in a second direction.

In practice, the first blades draw air across a condensing unit, and the second blades draw air up through a motor to cool the motor. The motor shaft, the first blades, and the second blades are combined into a single part to improve efficiency. This single part is either manufactured through a molding process or assembled from components manufactured from stamped metal.

DETAILED DESCRIPTION OF THE INVENTION

Figure 1:
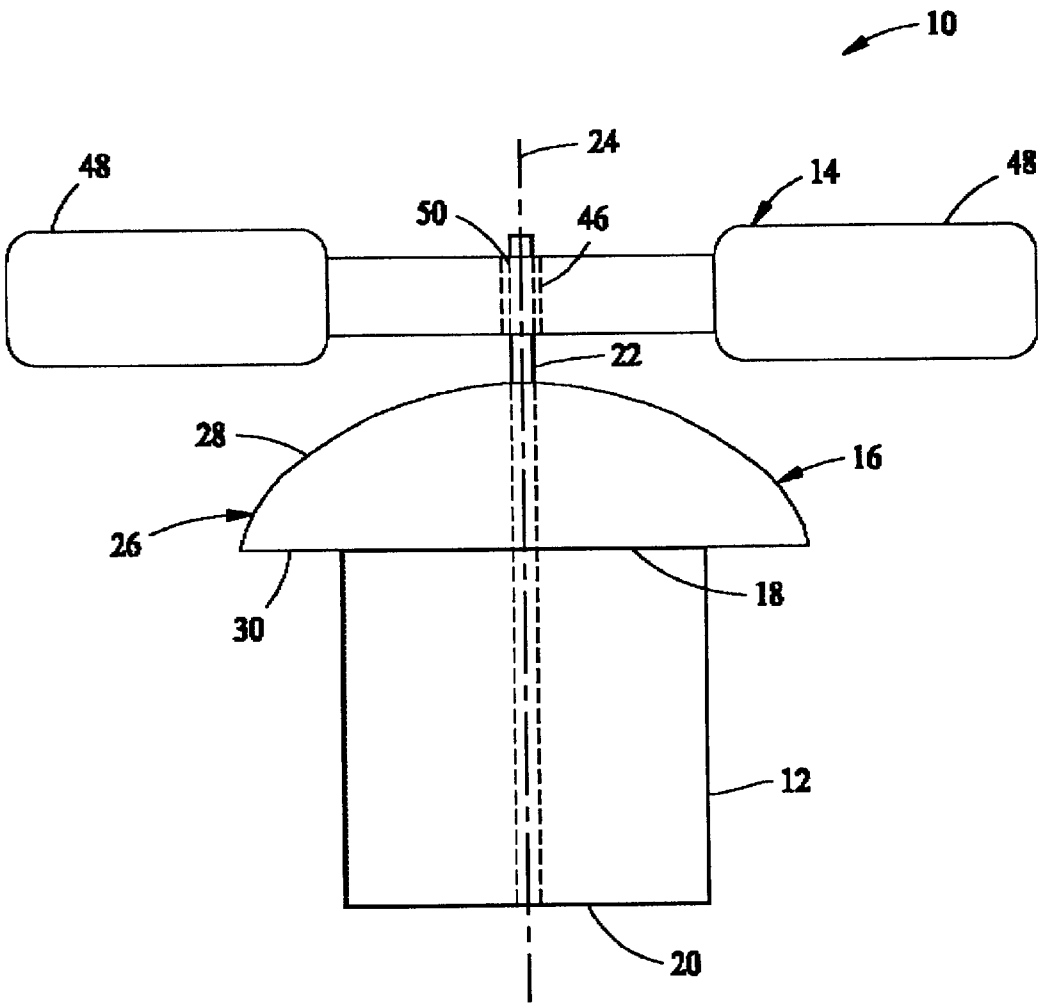
FIG. 1 is a side schematic view of a known motor assembly including an axial flow fan and a centrifugal fan.

FIG. 1 is a side schematic view of a known motor assembly 10 including a motor 12, an axial flow fan 14, and a centrifugal fan 16. In motor assembly 10, axial flow fan 14, motor 12, and centrifugal flow fan 16 are separate components.

Motor 12 includes a first end 18 and a second end 20. Axial fan 14 and centrifugal fan 16 are rotatably coupled to a shaft 22 that permits fans 14 and 16 to rotate about an axis of symmetry 24. Centrifugal fan 16 includes a housing 26 that includes a curved body portion 28 and a substantially planar body portion 30 extending from curved body portion 28. Curved body portion 28 is substantially convex and defines a cavity therein (not shown). A plurality of internal cooling fins (not shown) extend radially outwardly from shaft 22 toward housing curved body portion 28.

Centrifugal fan 16 is typically manufactured from molded plastic, and is rotatably mounted to shaft 22 adjacent motor first end 18. Axial flow fan 14 includes a hub 46 having a bore 50 therethrough that receives shaft 22. Axial flow fan 14 also includes axial impellers 48. In one embodiment, axial impellers 48 are assembled from stamped metal components. In an alternative embodiment, axial impellers 48 are molded as a single plastic part. Axial flow fan 14 is rotatably mounted to shaft 22.

Figure 2:
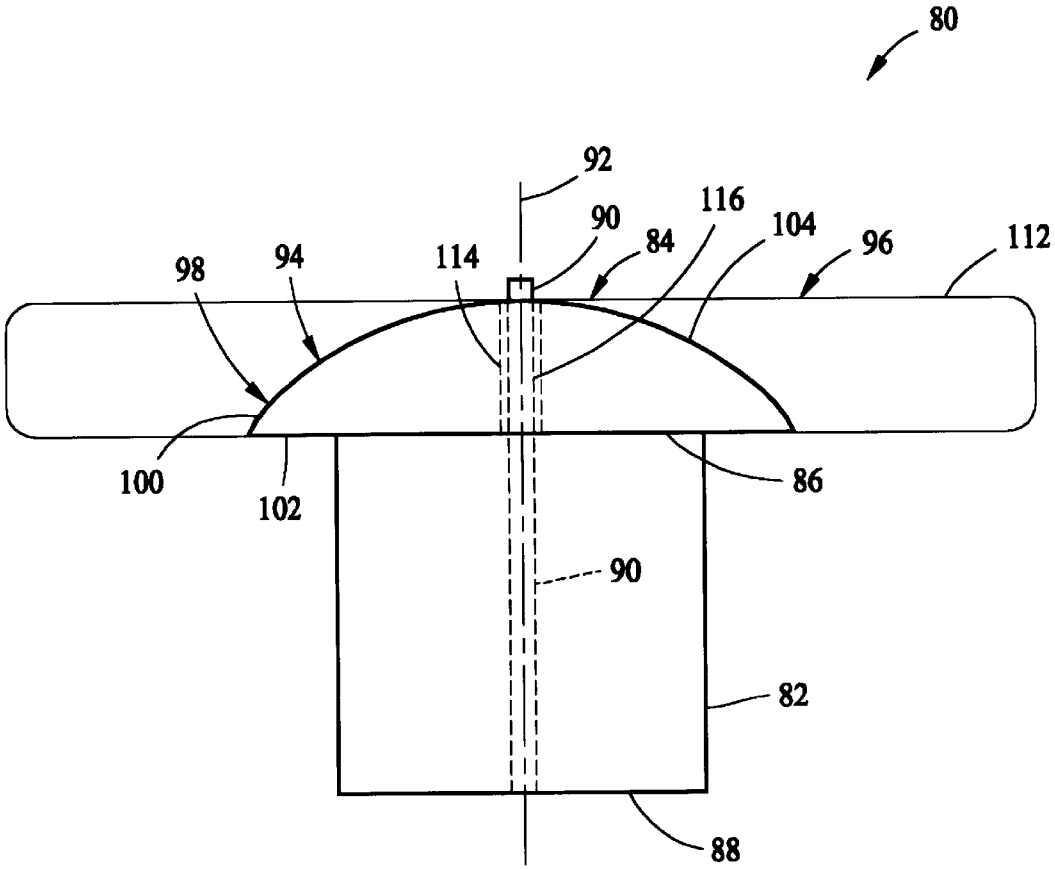
FIG. 2 is a side schematic view of a motor assembly including a compound fan assembly.

FIG. 2 is a side schematic view of a motor assembly 80 in accordance with one embodiment of the present invention. Motor assembly 80 includes a motor 82 and a single piece fan assembly 84. Motor 82 includes a first end 86 and a second end 88.

Single piece fan assembly 84 is rotatably coupled to a shaft 90. Shaft 90 permits fan assembly 84 to rotate about an axis of symmetry 92. Fan assembly 84 includes a centrifugal flow portion 94 and a propeller or axial flow portion 96. Centrifugal flow portion 94 includes a housing or body 98 that includes a curved body portion 100 and a substantially planar body portion 102 extending from curved body portion 100. Body 98 is configured to prevent moisture from entering motor 82. Curved body portion 100 is substantially convex and includes an outer surface 104 defining a cavity 106 therein (not shown in FIG. 2). Curved body portion 100 further includes an inner surface 108 (not shown in FIG. 2). Centrifugal flow portion 94 includes a plurality of internal cooling fins or first blades (not shown in FIG. 2) extending radially inwardly from inner surface 108 toward shaft 90. In one embodiment, the first blades are entirely within cavity 106. In an alternative embodiment, the first blades are partially within cavity 106. In a further alternative embodiment, at least a portion of the first blades contact shaft 90.

Axial flow portion 96 of single piece fan assembly 84 includes a plurality of impellers or second blades 112 rotatably coupled to shaft 90. Second blades 112 extend radially outwardly from body outer surface 104. Body 98, the first blades, and second blades 112 are concentric about shaft 90 and axis of symmetry 92. Fan assembly 84 includes a hub 114 that has a bore 116 therethrough configured to receive shaft 90.

In one embodiment, shaft 90 is integral with single piece fan assembly 84. Particularly, single piece fan assembly 84 including shaft 90, body 98, the first blades, and second blades 112, is unitary and is molded as a single part from a material such as plastic or metal. In an alternative embodiment, single piece fan assembly 84 including body 98, the first blades, and second blades 112, is unitary and is molded as a single part from a material such as plastic or metal. In a further alternative embodiment, single piece fan assembly 84 including shaft 90 is assembled from stamped metal components. Fan assembly hub 114 is coupled to shaft 90 using a heat expansion process. More particularly, hub 114 is heated until bore 116 increases in diameter. Fan assembly 84 subsequently receives shaft 90 by way of bore 116. Various cooling methods may be used to shrink hub 114 to its original diameter in order to permanently attach fan assembly 84 to shaft 90.

In an alternative embodiment, second blades 112 are assembled from stamped metal components and are coupled to body 98 that is molded integrally with the first blades. In a further alternative embodiment, the first blades and second blades 112 are two separate stamped metal components and are subsequently assembled with shaft 90 to form single piece fan assembly 84. In yet another alternative embodiment, fan assembly 84 including shaft 90 is cast.

It is contemplated that the present invention may be practiced with a variety of configurations with regard to the fabrication and assembly of single fan piece assembly 84. Therefore the above configurations are provided for exemplary purposes only and are not intended to limit the invention to any particular configuration.

Figure 3:
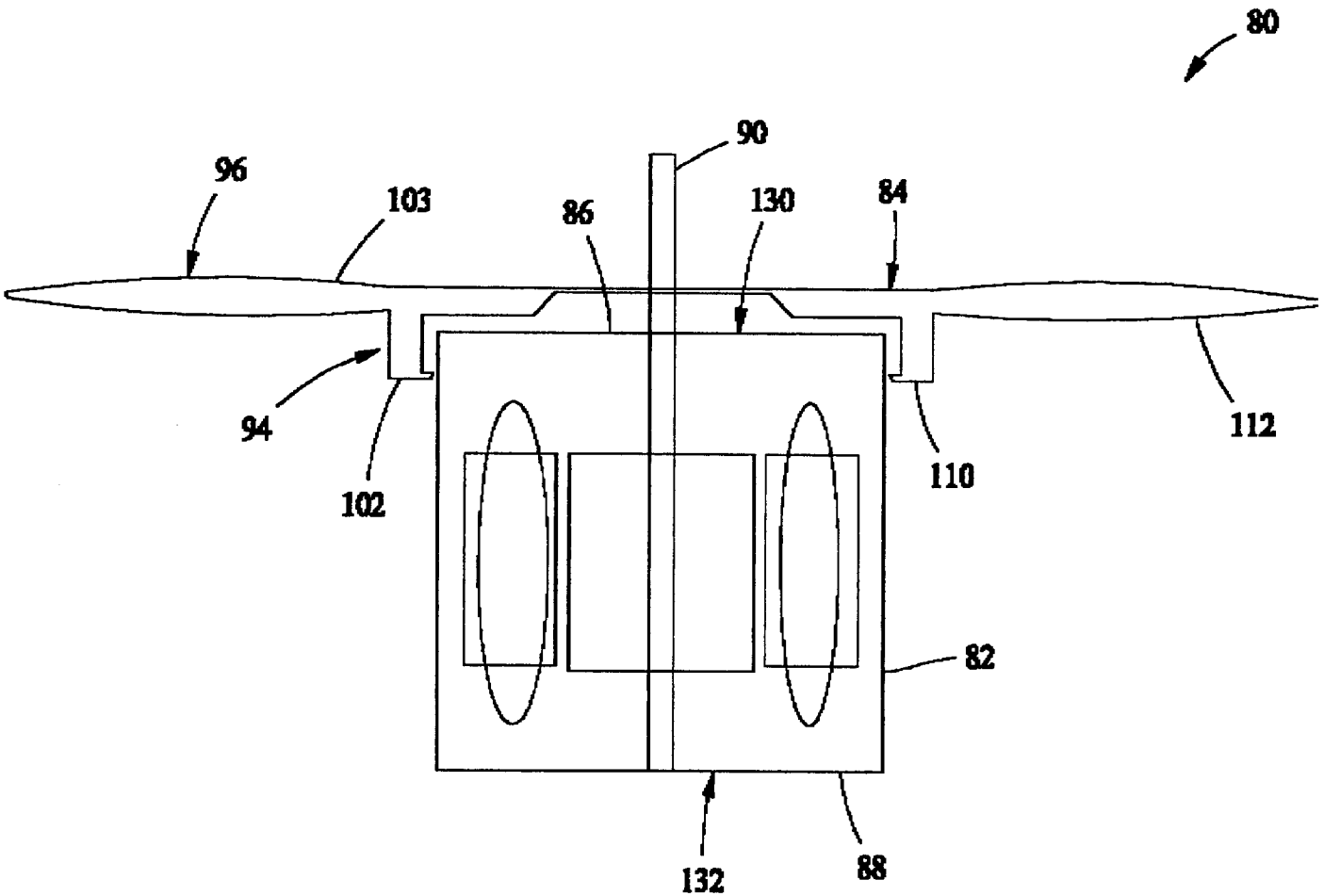
FIG. 3 is a side sectional view of the motor assembly from FIG. 2 including a cross section of a first and second blade.

FIG. 3 is a side sectional view of motor assembly 80 including a cross section of one of a first blades 120 and one of second blades 112. Centrifugal flow portion 94 including first blades 120 is configured to discharge air in a first direction, and axial flow portion 96 including second blades 112 is configured to discharge air in a second direction. In one embodiment, the first direction is substantially perpendicular to the second direction. Motor 82 includes open end shields 130 and 132 configured to allow air to pass through motor 82. The number of impellers 112 and the number of first blades 120 is determined to accommodate the specific application in which motor 82 is being utilized.

Figure 4:
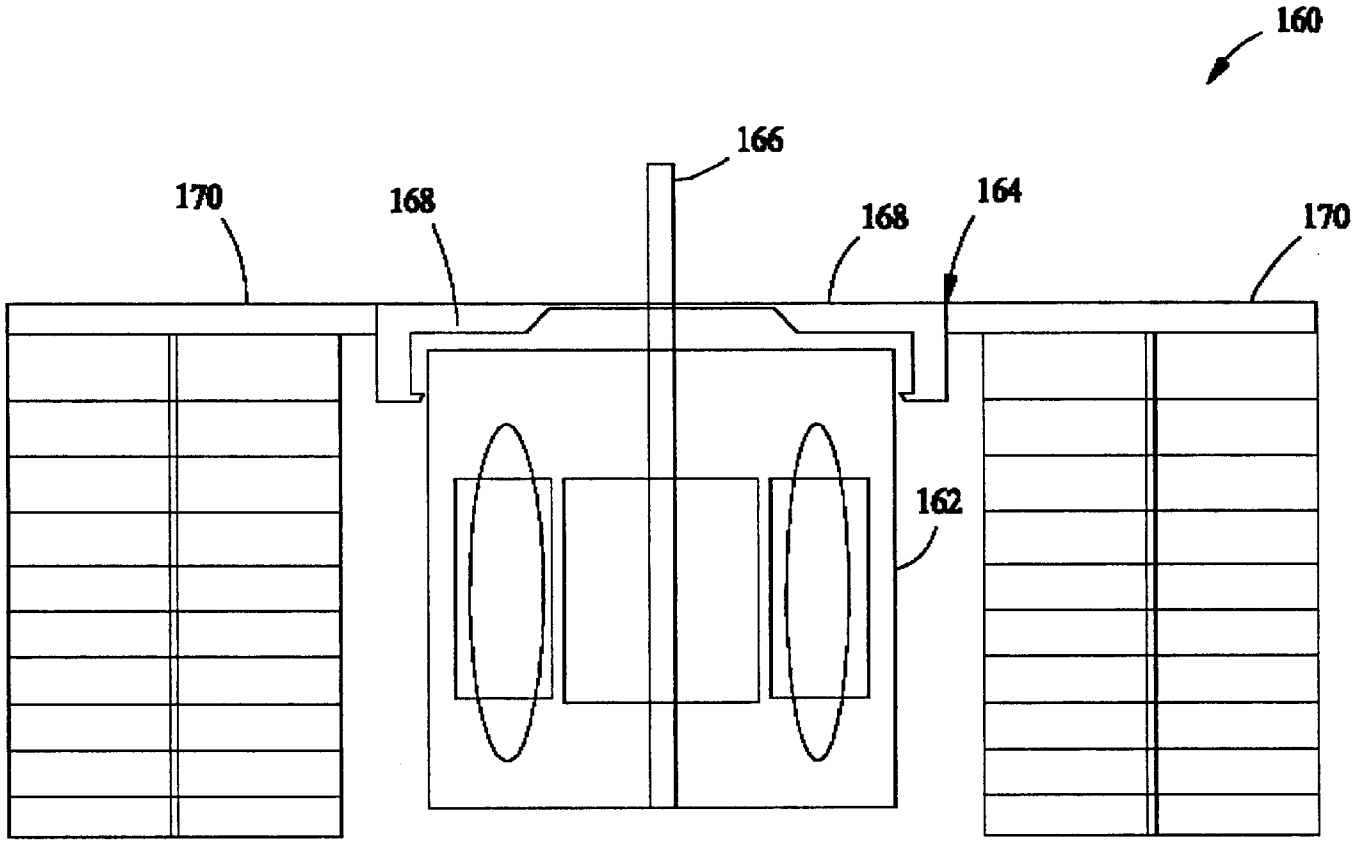
FIG. 4 is a side sectional view of a motor assembly including an alternative embodiment of a compound fan assembly.

FIG. 4 is a side schematic view of a motor assembly 160 including an alternative embodiment of a combination fan assembly. Motor assembly 160 includes motor 162 and single piece fan assembly 164. Fan assembly 164 is rotatably coupled to motor 162 with a motor shaft 166. In this particular embodiment, single piece fan assembly 164 is assembled by combining two centrifugal flow fans 168 and 170. Centrifugal flow fans 168 and 170 are two separate stamped metal components separated by a blower wheel center plate 172 and are assembled to form single piece fan assembly 164. Centrifugal flow fans 168 and 170 are configured to discharge air in substantially the same direction.

Figure 5:
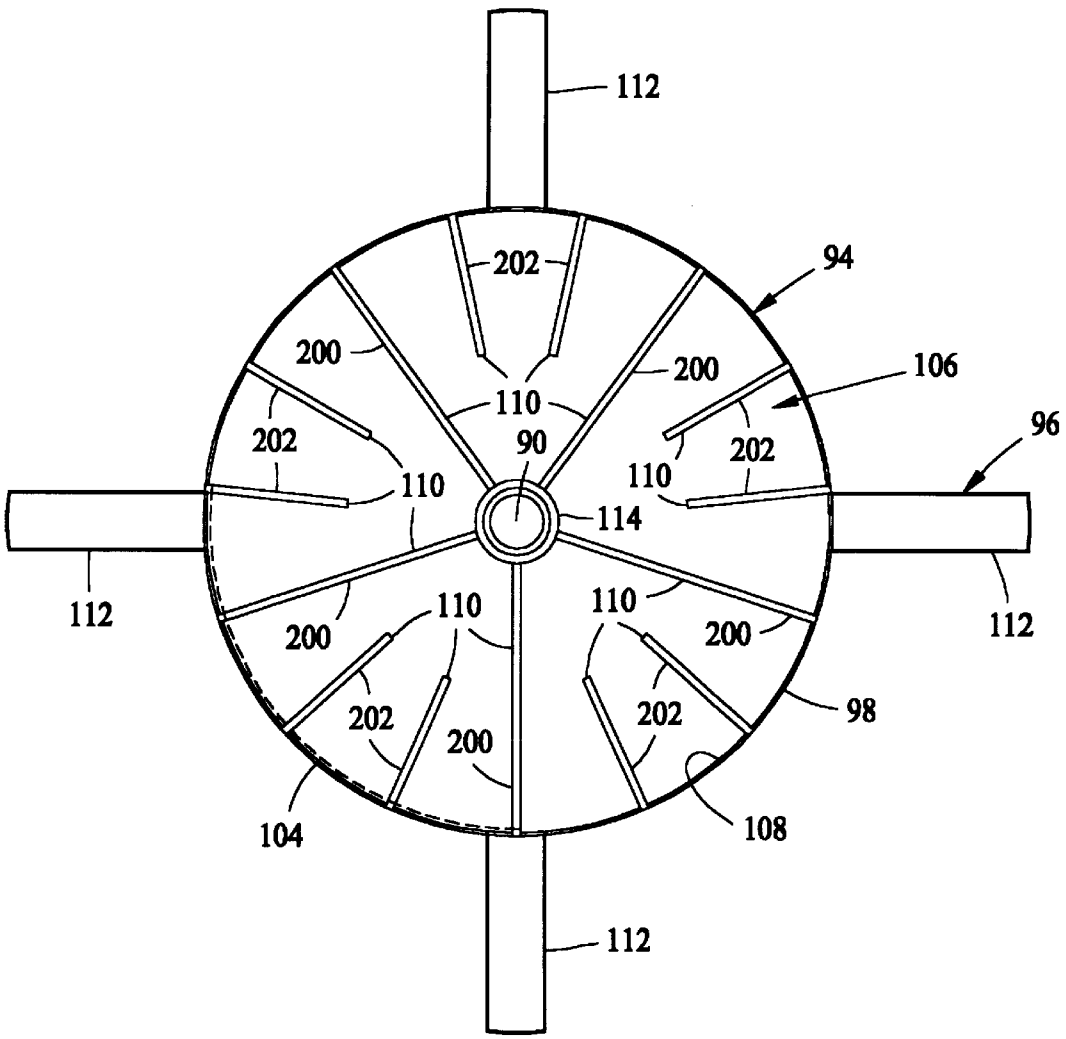
FIG. 5 is a top view of the compound fan assembly shown in FIG. 2.

FIG. 5 is a bottom view of the combination fan assembly shown in FIG. 2 including an exemplary embodiment of centrifugal flow portion 94 axial flow portion 96 and shaft 90. Centrifugal flow portion 94 includes body 98 including inner surface 108 and outer surface 104 (seen in FIG. 2). Body 98 further includes body cavity 106. Centrifugal fan 94 is manufactured in such a way as to ensure that the material within body 98 is evenly distributed due to the need for static balance. In one embodiment, first blades 120 includes long blades 200 and short blades 202. Long blades 200 extend to hub 114 from inner surface 108 of centrifugal fan 94. Short blades 202 extend from inner surface 108 toward hub 114, but do not contact hub 114. Blades 200 and 202 are equi-angularly spaced about hub 114. Axial portion 96 including second blades 112 is mounted on outer surface 104 of body 98.

In practice, a motor in a condensing unit is operated in a synchronized manner with a combined centrifugal and axial flow fan integrally formed with a motor shaft. The centrifugal flow fan component is configured to direct air over the motor to provide cooling, and the axial flow fan component is configured to direct air across the condenser unit. Combining the fans reduces the length of the shaft on which the fans are mounted which effectively reduces vibration in and around the motor. In addition, because the centrifugal and axial flow fans are integral with the shaft, they can be positioned at an optimum location on the shaft with regard to minimizing vibration and noise. Additionally, the implementation of the present invention in consumer motors and controls and HVAC applications reduces the number of parts, and ultimately the cost of the product.

While the invention has been described in terms of various specific embodiments, those skilled in the art will recognize that the invention can be practiced with modification within the spirit and scope of the claims.

What is claimed:

1. A method of assembling a motor assembly comprising the steps of:

providing a fan sub-assembly driven by a motor shaft, wherein the fan sub-assembly comprises a body, a plurality of first blades and a plurality of second blades, the body further comprising an outer surface defining a cavity, the plurality of second blades extending radially outwardly from the body outer surface, the body further comprises an inner surface, the plurality of first blades extending radially inwardly from the body inner surface to a hub within the body cavity; and attaching the fan sub-assembly to a motor.

2. A method in accordance with claim 1 wherein the step of providing a fan sub-assembly comprises the step of casting the fan sub-assembly.

3. A fan assembly in accordance with claim 2 wherein said plurality of first blades and said plurality of second blades formed integrally with said body and said shaft.

4. A method in accordance with claim 1 wherein the step of providing a fan sub-assembly comprises the step of stamping the fan sub-assembly from metal components.

5. A method in accordance with claim 1 wherein the step of providing a fan sub-assembly comprises the step of molding the fan sub-assembly.

6. A method in accordance with claim 1 wherein the plurality of first blades and the plurality of second blades are formed integrally with the body.

7. A method in accordance with claim 1 wherein said step of attaching the fan sub-assembly to a motor comprises the step of attaching the fan sub-assembly to the motor shaft.

8. A method in accordance with claim 7 wherein said step of attaching the fan sub-assembly to a motor shaft comprises a heat expansion process.

9. A fan assembly driven by a motor shaft comprising a body comprising a plurality of first blades and a plurality of second blades, said body further comprising an outer surface defining a cavity, said plurality of second blades extending radially outwardly from said body outer surface, said body further comprising an inner surface, the plurality of first blades extending radially inwardly from the body inner surface to a hub within said body cavity.

10. A fan assembly in accordance with claim 9 further comprising a shaft, said plurality of second blades rotatably coupled to said shaft, said body concentric with said shaft.

11. A fan assembly in accordance with claim 10 wherein said fan assembly is assembled from stamped metal components.

12. A fan assembly in accordance with claim 9 wherein said plurality of first blades configured to discharge air in a first direction, said plurality of second blade s configured to discharge air in a second direction.

13. A fan assembly in accordance with claim 12 said first direction substantially perpendicular said second direction.

14. A fan assembly in accordance with claim 9 wherein said fan assembly is molded, said fan assembly further comprising a hub having a bore extending therethrough.

15. A motor assembly comprising:

a motor; and a fan sub-assembly driven by a motor shaft rotatably coupled to said motor and comprising a body, a plurality of first blades, and a plurality of second blades, said body further comprising an outer surface defining a cavity, said plurality of second blades extending radially outwardly from said body outer surface, said body further comprising an inner surface, the plurality of first blades extending radially inwardly from the body inner surface to a hub within said body cavity.

16. A motor assembly in accordance with claim 15 wherein said fan sub-assembly further comprises a shaft , said plurality of second blades rotatably coupled to said shaft, said body concentric with said shaft.

17. A motor assembly in accordance with claim 16 wherein said plurality of first blades and said plurality of second blades formed integrally with said body and said shaft.

18. A motor assembly in accordance with claim 16 wherein said fan sub-assembly is assembled from stamped metal components.

19. A motor assembly in accordance with claim 15 wherein said fan sub-assembly plurality of first blades configured to discharge air in a first direction, said fan sub-assembly plurality of second blades configured to discharge air in a second direction.

20. A motor assembly in accordance with claim 19 wherein the first direction is substantially perpendicular to the second direction.

21. A motor assembly in accordance with claim 15 wherein said fan sub-assembly is molded, said fan sub-assembly further comprising a hub having a bore extending therethrough.

22. A motor assembly in accordance with claim 15 wherein said fan assembly configured to prevent moisture from entering said motor.

* * * * *

UNITED STATES PATENT AND TRADEMARK OFFICE

CERTIFICATE OF CORRECTION

PATENT NO. : 6,494,681 B2
DATED : December 17, 2002
INVENTOR(S) : Andrew C. Barry et al.

It is certified that error appears in the above-identified patent and that said Letters Patent is hereby corrected as shown below:

Column 4,
Line 49, delete "body comprising" and insert therefor -- body, --.
Line 64, delete "blade s" and insert therefor -- blades --.
Line 66, after "12" insert -- wherein --.

Signed and Sealed this

Fifteenth Day of July, 2003

JAMES E. ROGAN
*Director of the United States Patent and Trademark Office*